US011674430B2

(12) United States Patent
Coviello

(10) Patent No.: US 11,674,430 B2
(45) Date of Patent: Jun. 13, 2023

(54) ADJUSTABLE EXHAUST BACKPRESSURE DEVICE

(71) Applicant: American Outlaw, LLC, Lutz, FL (US)

(72) Inventor: Randy Coviello, Lutz, FL (US)

( * ) Notice: Subject to any disclaimer, the term of this patent is extended or adjusted under 35 U.S.C. 154(b) by 102 days.

(21) Appl. No.: 17/372,647

(22) Filed: Jul. 12, 2021

(65) Prior Publication Data

US 2023/0011637 A1 Jan. 12, 2023

(51) Int. Cl.
*F01N 13/08* (2010.01)
*F01N 1/16* (2006.01)

(52) U.S. Cl.
CPC ..... *F01N 13/08* (2013.01); *F01N 1/165* (2013.01)

(58) Field of Classification Search
CPC ..... F01N 2240/36; F01N 1/166; F01N 1/163; F01N 1/16; F01N 2260/14; F01N 2260/06; F01N 2450/24
See application file for complete search history.

(56) References Cited

U.S. PATENT DOCUMENTS 1,860,146 A * 5/1932 Gray ..... F01N 1/166 181/254
3,620,330 A * 11/1971 Hall ..... F01N 1/003 235/45
3,703,937 A * 11/1972 Tenney ..... F02B 27/06 60/314
8,851,231 B1 * 10/2014 Murphy ..... F01N 1/168 181/254
2007/0107981 A1 * 5/2007 Sicotte ..... F01N 1/22 181/237
2009/0229913 A1 * 9/2009 Tonietto ..... F01N 1/083 181/254

* cited by examiner

*Primary Examiner* — Anthony Ayala Delgado
(74) *Attorney, Agent, or Firm* — Larson & Larson; Justin P. Miller; Frank Liebenow

(57) ABSTRACT

The adjustable exhaust backpressure device allows for post-installation adjustment of additional backpressure. This allows a user to adjust how much backpressure is generated by testing, adjusting, and then re-testing. The adjustment can generally be performed without removing the device from the exhaust, and without replacing any parts. The adjustable exhaust backpressure device can be placed in any location following the engine. The adjustable exhaust backpressure device includes a body with an exhaust inlet and an exhaust outlet.

6 Claims, 9 Drawing Sheets

ADJUSTABLE EXHAUST BACKPRESSURE DEVICE

FIELD

This invention relates to the field of exhaust devices and more particularly to a device that allows for adjustment of exhaust backpressure following installation.

BACKGROUND

Vehicle engine performance and sound are affected by the engine's exhaust system. Specifically, by the backpressure—or resistance to the flow of exhaust gas—created by the exhaust piping and components.

Devices are available to affect the backpressure of an exhaust system. But the devices lack features that allow a user to adjust the backpressure after installation. The result is that a user must purchase the item, install it, test it, and then determine whether the device performs as desired. If not, it must be removed and replaced. This is costly and complicated.

What is needed is a device that allows for adjustment after installation, allowing the user to tune the backpressure to the specific exhaust and to personal preference.

SUMMARY

The adjustable exhaust backpressure device allows for post-installation adjustment of backpressure. This allows a user to adjust how much backpressure is generated by testing, adjusting, and then re-testing. The adjustment can generally be performed without removing the device from the exhaust, and without replacing any parts.

The adjustable exhaust backpressure device can be placed in any location following the catalytic converter.

The adjustable exhaust backpressure device includes a body with an exhaust inlet and an exhaust outlet. The exhaust passes through a chamber.

A pressure plate sits within the chamber, affixed to the body by a fastener. The fastener preferably passes through a single static hole in the body, interfacing with the pressure plate at one or more holes. In the preferred embodiment, the holes in the pressure plate each include a threaded adapter, allowing the user to thread the fastener from outside of the body, simplifying installation.

The pressure plate is preferably formed from a stabilizing face and a resisting face. The stabilizing face rests against a stabilizing wall of the chamber, the resisting face placed in the flow of exhaust through the chamber. In the preferred embodiment, the stabilizing face and the stabilizing wall are flat and co-planar, thus simplifying installation.

The user is able to place the pressure plate in two or more positions with respect to the inlet. By moving the pressure plate closer to, or further from, the inlet, the backpressure is adjusted. This allows the user to adjust the backpressure as desired.

The inlet is preferably a tapered shape with a first, narrower end away from the chamber, and a second, wider end toward the chamber.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
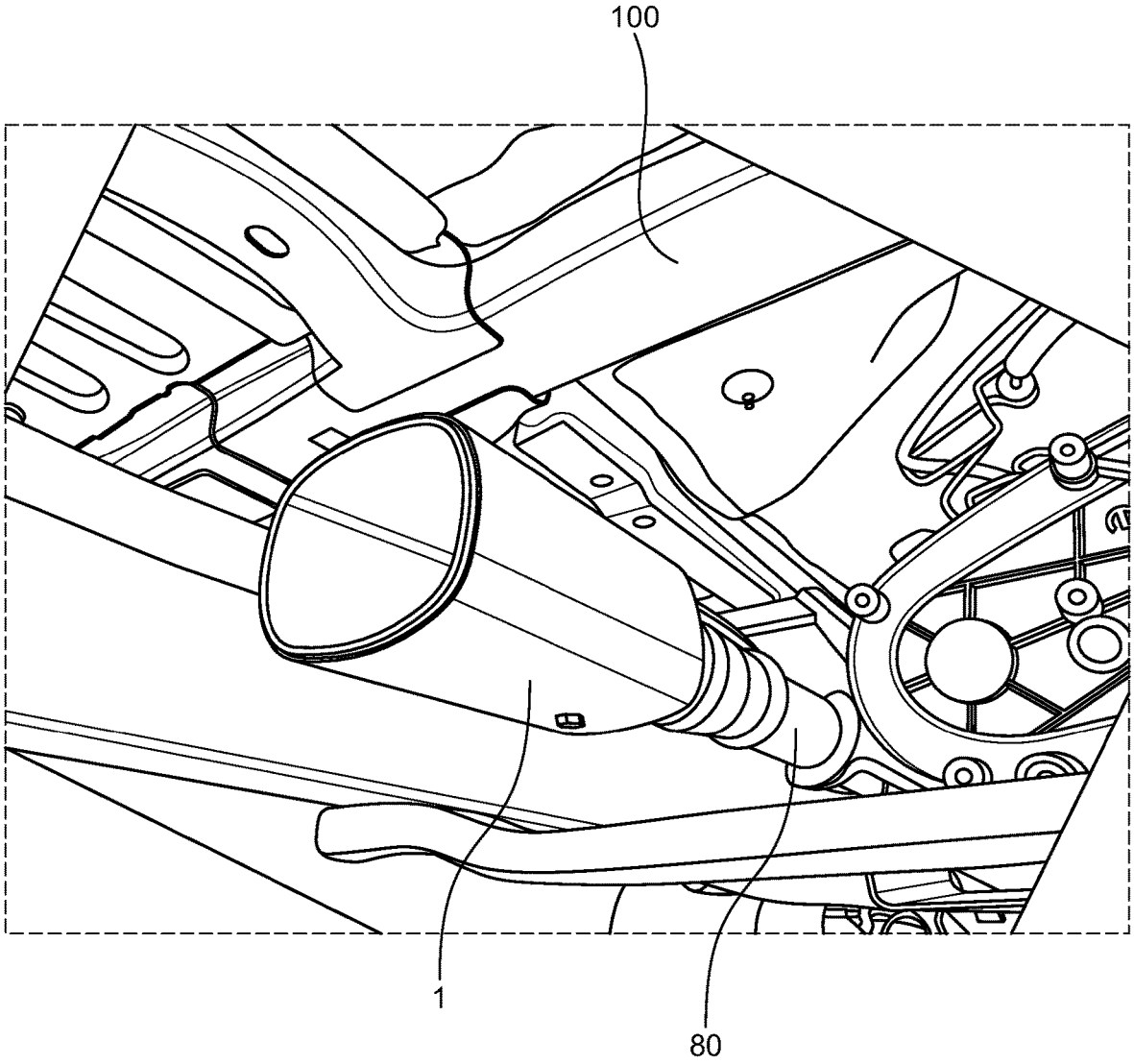
FIG. 1 illustrates an installed view of the adjustable exhaust backpressure device.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an installed view of the adjustable exhaust backpressure device is shown.

The adjustable exhaust backpressure device 1 is shown installed under a vehicle 100, affixed to the exhaust pipe 80.

Figure 2:
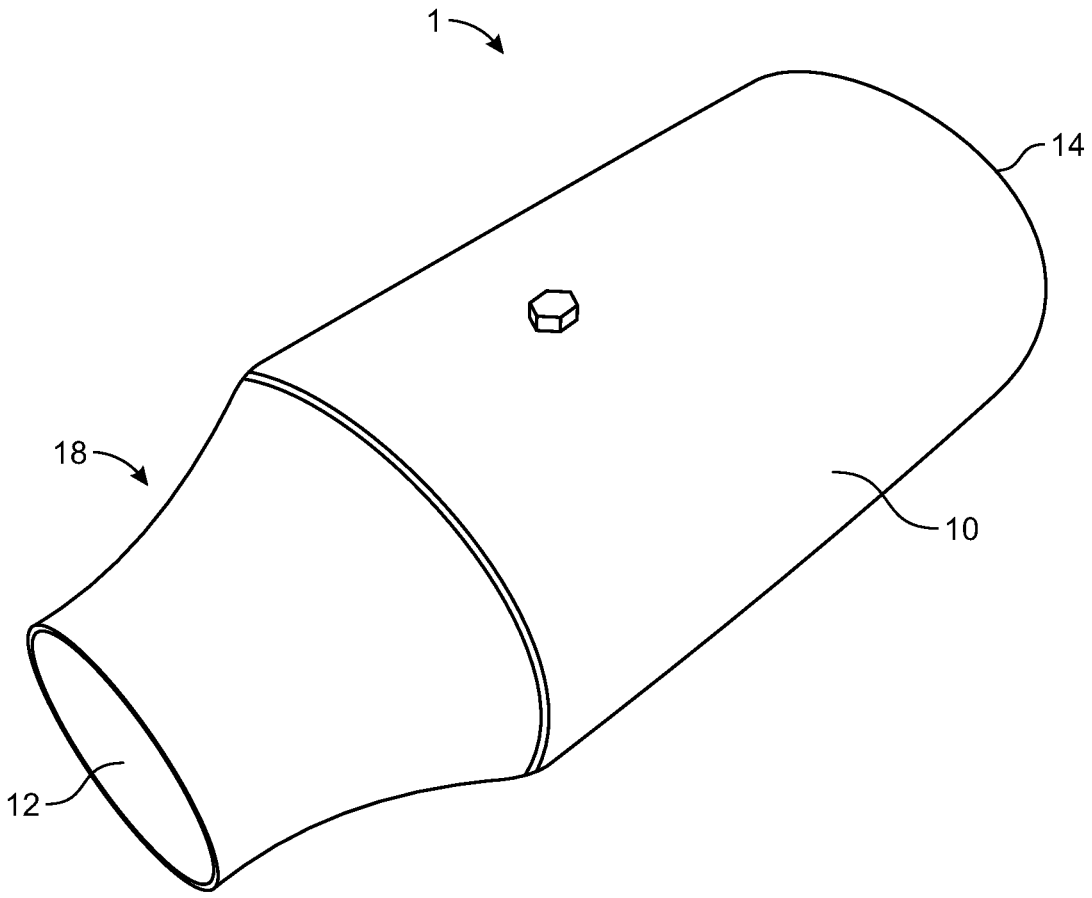
FIG. 2 illustrates a first isometric view of the adjustable exhaust backpressure device.

Referring to FIG. 2, a first isometric view of the adjustable exhaust backpressure device is shown.

The adjustable exhaust backpressure device 1 includes a body 10 that includes an inlet 12 and outlet 14, with a taper 18 between the inlet 12 and chamber 16 (see FIG. 5).

Figure 3:
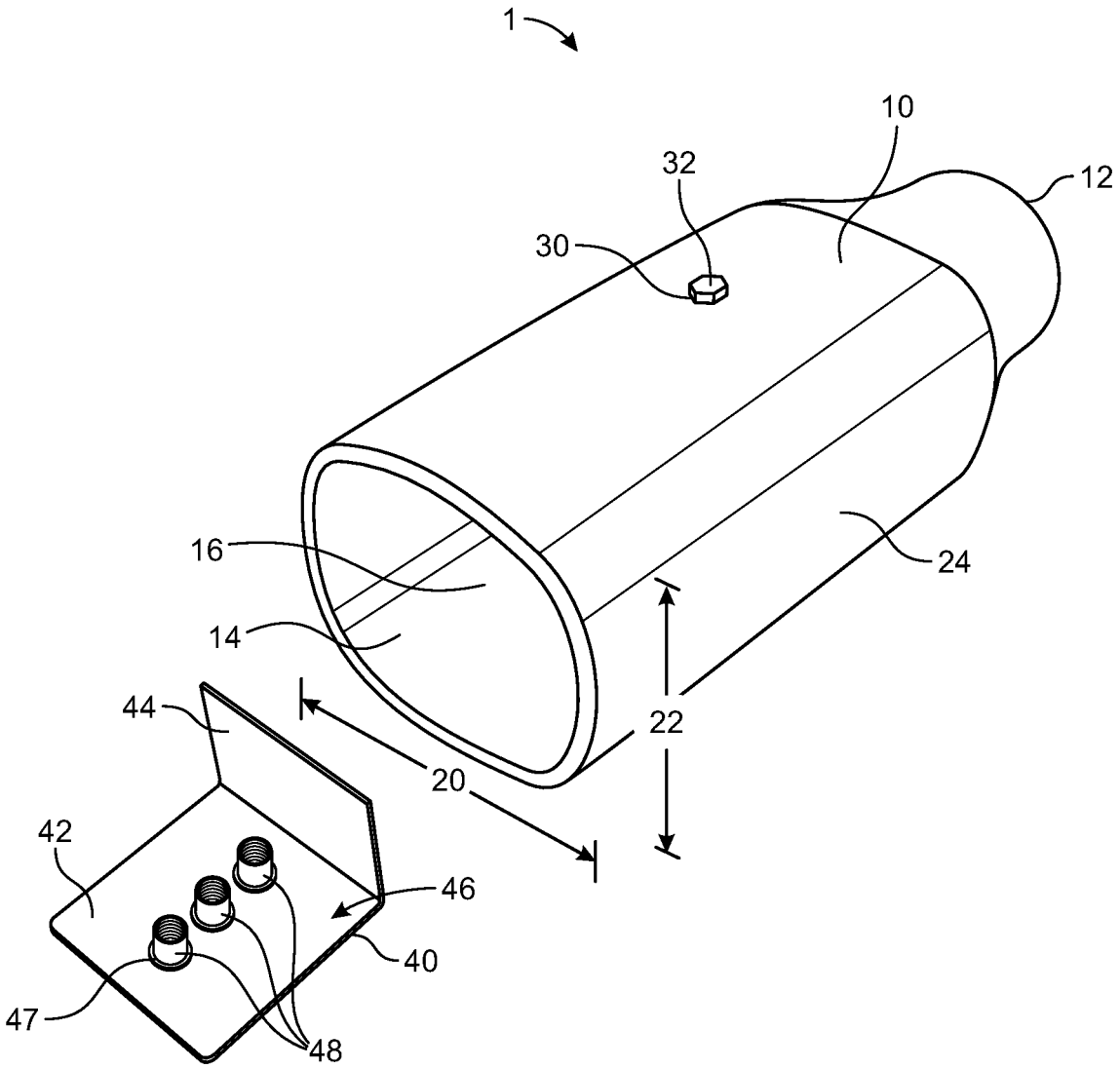
FIG. 3 illustrates a second isometric view, with the pressure plate removed, of the adjustable exhaust backpressure device.
Figure 4:
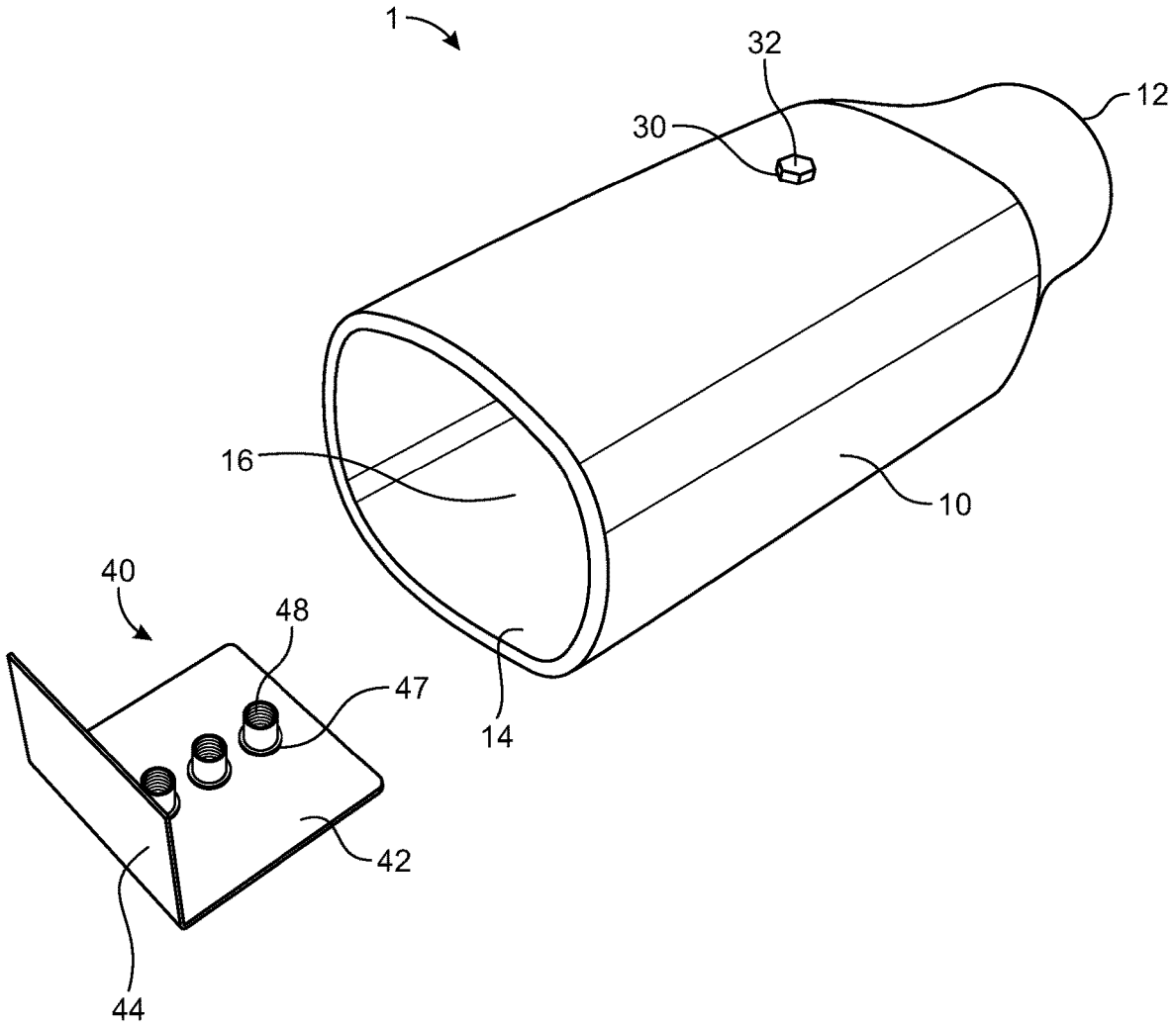
FIG. 4 illustrates a third isometric view, with the pressure plate removed and reversed, of the adjustable exhaust backpressure device.

Referring to FIGS. 3 and 4, a second isometric view and third isometric view, with the pressure plate removed of the adjustable exhaust backpressure device, are shown.

The adjustable exhaust backpressure device 1 is again shown with body 10, inlet 12, outlet 14, and chamber 16.

The body 10, at the outlet, has a first width 20 and a second width 22, preferably meeting at rounded corners 24.

A static hole 30 in the body 10 braces a fastener 32.

The fastener 32 connects the body 10 to the pressure plate 40.

The pressure plate 40 includes stabilizing face 42 that rests against the body 10, inside the chamber 16. The pressure plate 40 further includes a resisting face 44 at an angle 46 with respect to the stabilizing face 42.

The stabilizing face 42 includes multiple holes 47, each preferably adjacent to a threaded adapter 48.

The fastener 32 threads into a threaded adapter 48, locking the pressure plate 40 in the user's chosen position within the chamber 16.

Referring to FIG. 5, multiple partial cross-sections are shown, showing flowing exhaust and differing pressure plate positions of the adjustable exhaust backpressure device.

Figure 5A:
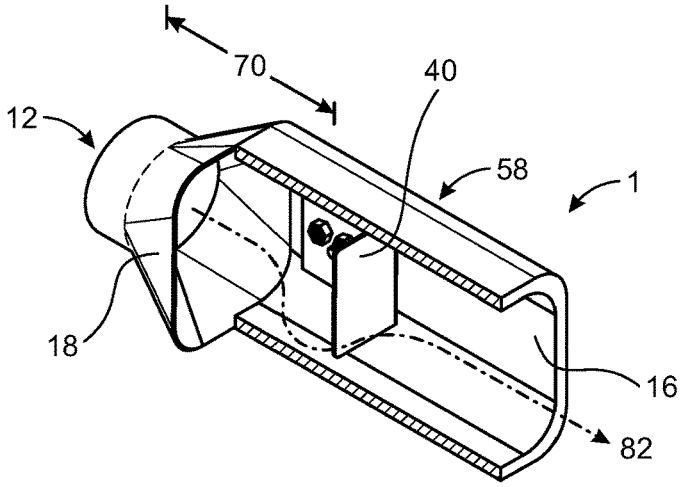
FIGS. 5A-C illustrate a partial cross-section, showing flowing exhaust and differing pressure plate positions, of the adjustable exhaust backpressure device.

FIG. 5A shows the pressure plate 40 in its first forward position 50.

Figure 5B:
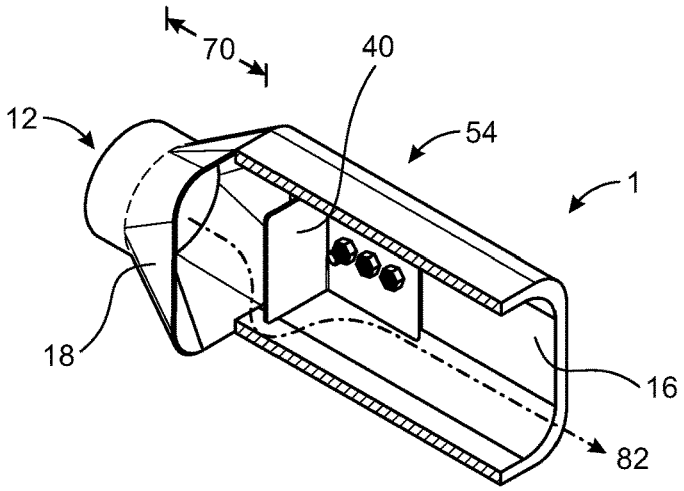

FIG. 5B shows the pressure plate 40 in third forward position 54.

Figure 5C:
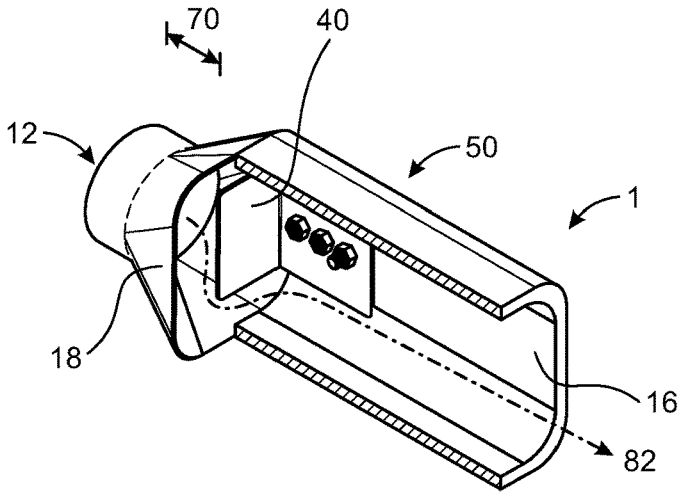

FIG. 5C shows the pressure plate 40 in its second rearward position 58.

FIGS. 5A, B, and C show exhaust gas 82 entering inlet 12 and passing around the pressure plate 40. By altering the position of the pressure plate 40 with respect to the inlet 12, and taper 18, the backpressure—or resistance to the flow of exhaust gas 82—is increased and decreased. The distance from the inlet 12 to the resisting face 44 (see FIG. 4) of the pressure plate 40 is referred to as the inlet-to-plate distance 70

Referring to FIGS. 6 through 11, views with the pressure plate multiple positions are shown.

The adjustable exhaust backpressure device 1 is shown with the pressure plate 40 in multiple positions. Common across the figures is the stabilizing face 42, resisting face 44, with the fastener 32 and threaded adapter 48 acting together to hold the pressure plate 40 in position against the stabilizing wall 17 of the body 10.

Figure 6A:
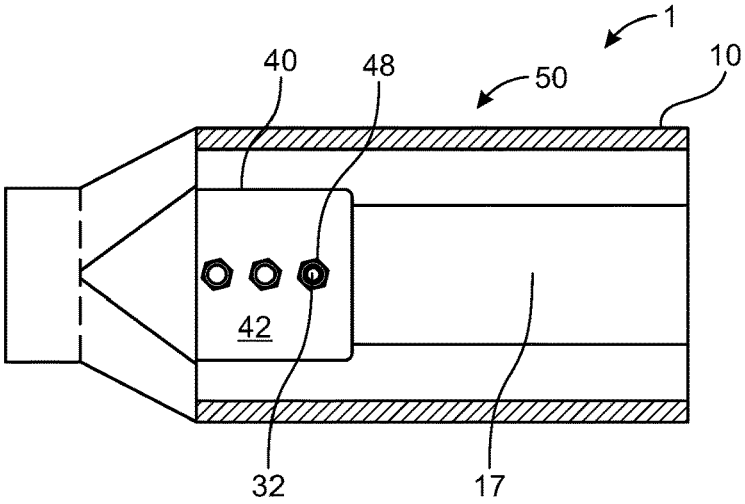
FIGS. 6A-B illustrate a view with the pressure plate in a first forward position, of the adjustable exhaust backpressure device.
Figure 6B:
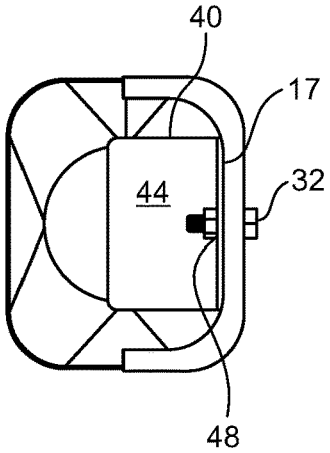

In FIG. 6, the pressure plate 40 is shown in first forward position 50

Figure 7A:
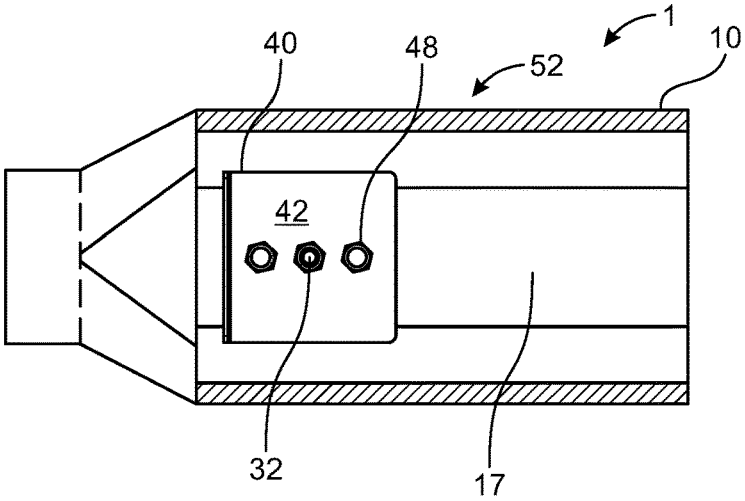
FIGS. 7A-B illustrate a view with the pressure plate in a second forward position, of the adjustable exhaust backpressure device.
Figure 7B:
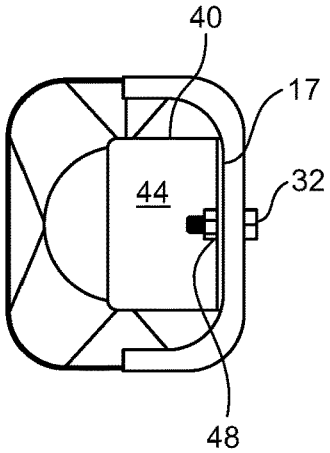

In FIG. 7, the pressure plate 40 is shown in second forward position 52.

Figure 8A:
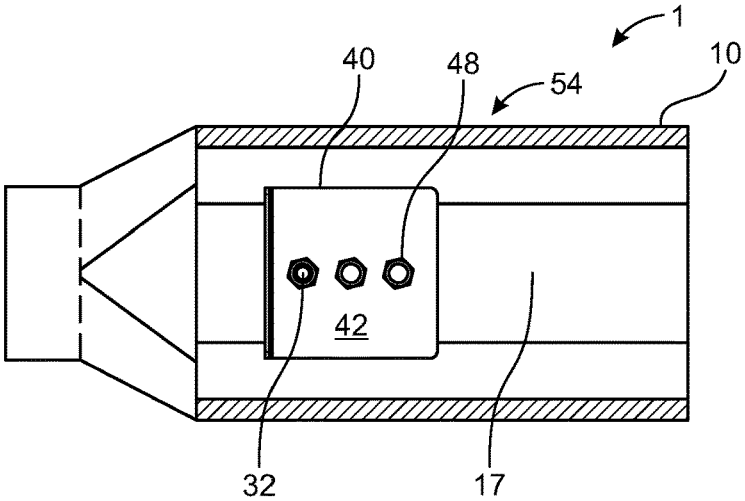
FIGS. 8A-B illustrate a view with the pressure plate in a third forward position, of the adjustable exhaust backpressure device.
Figure 8B:
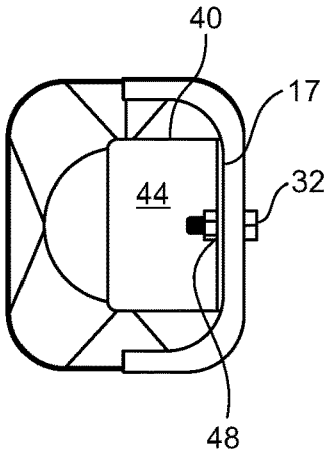

In FIG. 8, the pressure plate 40 is shown in third forward position 54.

Figure 9A:
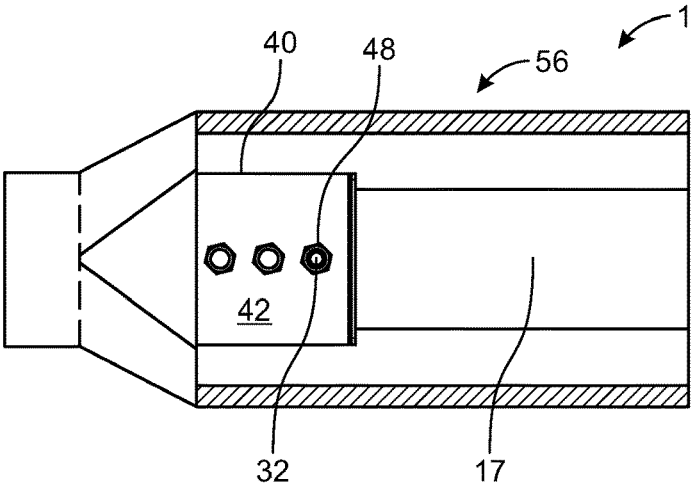
FIGS. 9A-B illustrate a view with the pressure plate in a first rearward position, of the adjustable exhaust backpressure device.
Figure 9B:
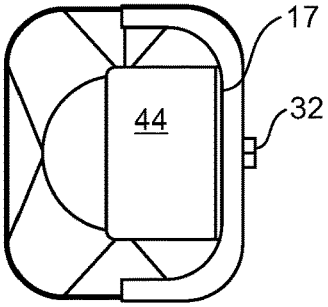

In FIG. 9, the pressure plate 40 is shown in first rearward position 56. By reversing the orientation of the pressure plate 40, additional position options of the resisting face 44 with respect to the inlet 12 are created, thus expanded a user's options for backpressure generation.

Figure 10A:
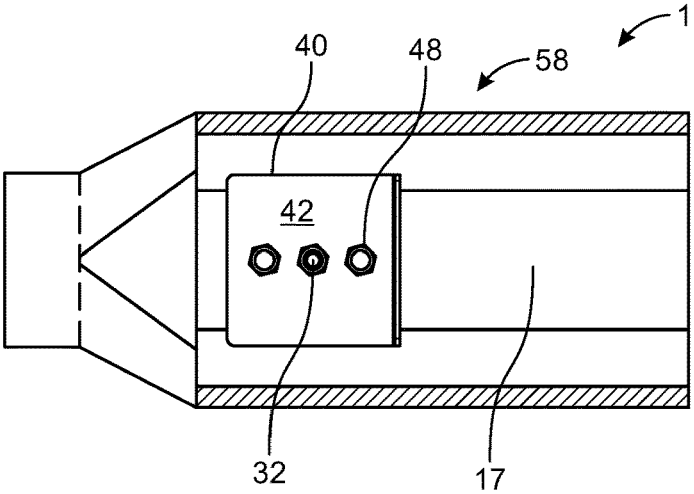
FIGS. 10A-B illustrate a view with the pressure plate in a second rearward position, of the adjustable exhaust backpressure device.
Figure 10B:
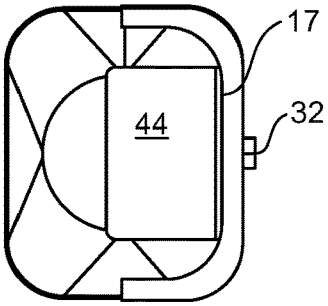

In FIG. 10, the pressure plate 40 is shown in second rearward position 58.

Figure 11A:
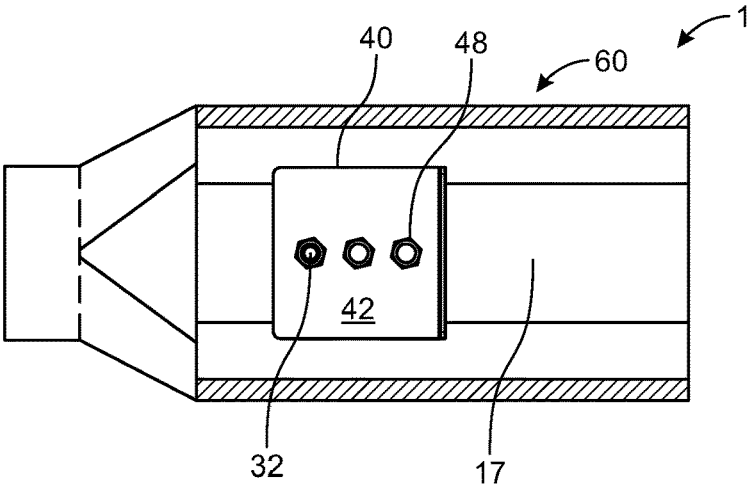
FIGS. 11A-B illustrate a view with the pressure plate in a third rearward position, of the adjustable exhaust backpressure device.
Figure 11B:
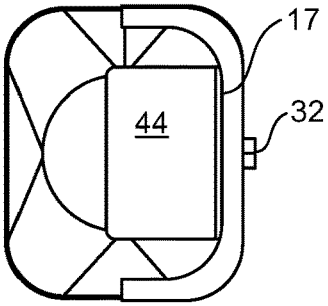
Figure 12A:
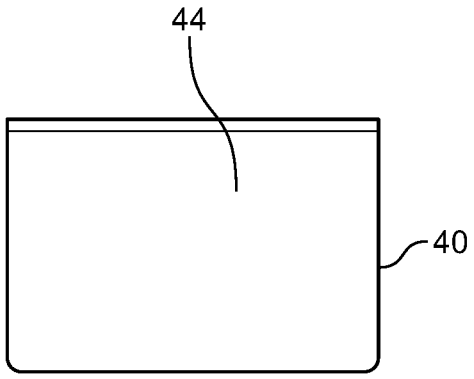
FIGS. 12A-D illustrate multiple views of the pressure plate of the adjustable exhaust backpressure device.
Figure 12B:
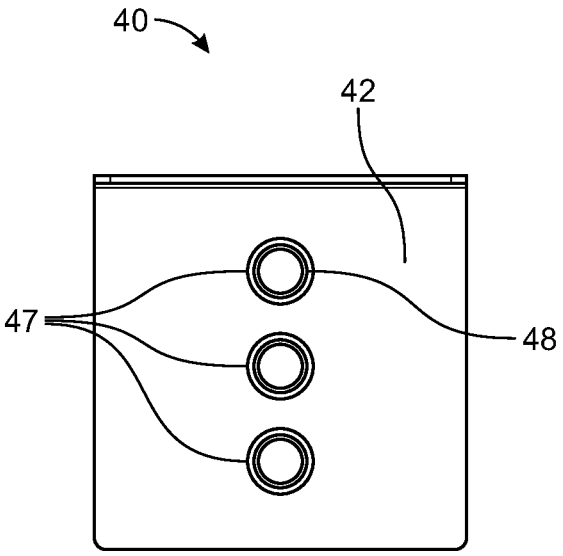
Figure 12C:
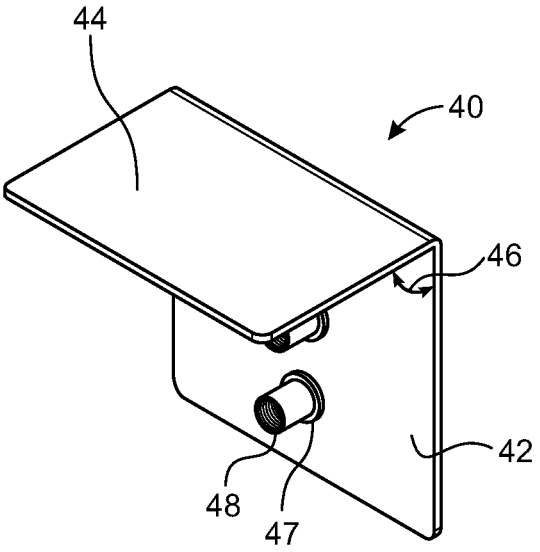
Figure 12D:
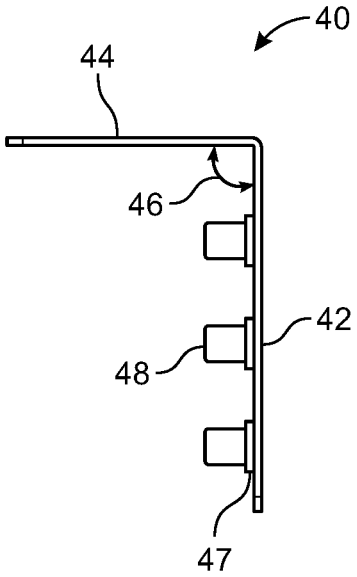

In FIG. 11, the pressure plate 40 is shown in third rearward position 60.

Referring to FIG. 12, multiple views of the pressure plate of the adjustable exhaust backpressure device are shown.

The pressure plate 40 is shown formed from a stabilizing face 42 and resisting face 44 separated by an angle 46. The angle 46 is shown as ninety degrees, but other angles are anticipated. For example, forty-five degrees, or one-hundred and thirty-five degrees.

One or more holes 47 are set within the stabilizing face 42, allowing for multiple positions of the pressure plate 40.

A threaded adapter 48 is preferably co-located with the one or more holes 47, allowing a fastener 32 to be threaded into the pressure plate 40.

Figure 13:
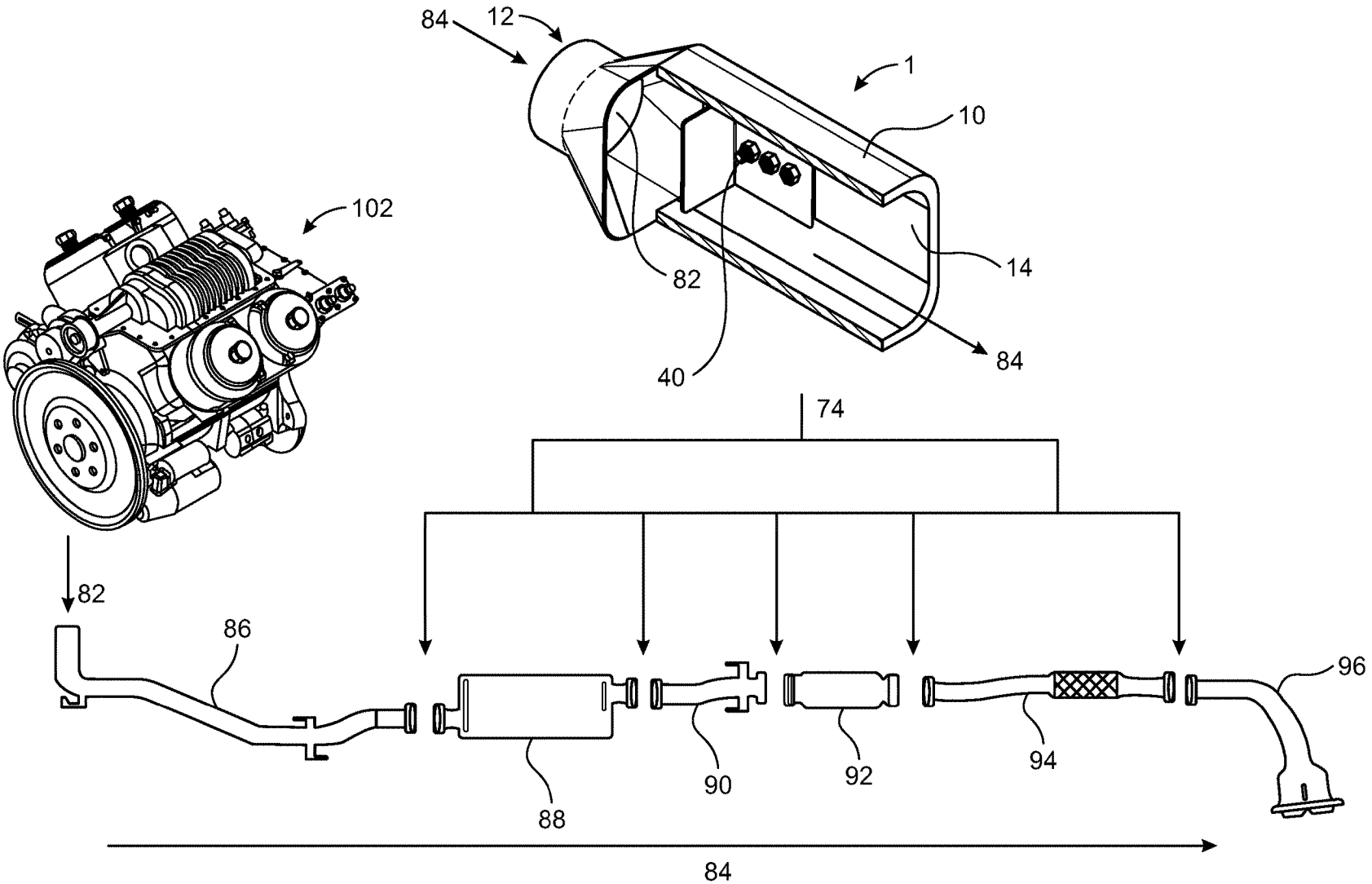
FIG. 13 illustrates installation locations of the adjustable exhaust backpressure device.

Referring to FIG. 13, installation locations of the adjustable exhaust backpressure device is shown.

The adjustable exhaust backpressure device 1 is shown with body 10, inlet 12, and outlet 14.

The pressure plate 40 sits within the exhaust flow path 84 of the exhaust gas 82.

There are multiple device installation locations 74 following the engine 102. Installation location options include after the downpipe 86, after the muffler 88, after the extension pipe 90, after the resonator 92, and between the tailpipe 94 and exhaust tip 96.

Equivalent elements can be substituted for the ones set forth above such that they perform in substantially the same manner in substantially the same way for achieving substantially the same result.

What is claimed is:

1. A backpressure creation device, the device installed in a flow of an exhaust gas, the device comprising:

a body;

the body including an inlet and an outlet;

a chamber within the body;

a pressure plate within the chamber;

the pressure plate including a stabilizing face and a resisting face;

the stabilizing face resting against the body;

the resisting face opposing the flow of the exhaust gas;

the stabilizing face removably affixed to the body;

the pressure plate above to be placed in two or more locations within the chamber, thus adjusting backpressure created as exhaust gas passes through the chamber;

whereby a user can alter a position of the pressure plate within the chamber to affect backpressure creation.

2. The backpressure creation device of claim 1, further comprising:

two or more threaded adapters affixed to the stabilizing face;

a removable fastener;

the removable fastener interfacing with one of the two or more threaded adapters, thus affixing the pressure plate with respect to the chamber.

3. The backpressure creation device of claim 1, wherein the pressure plate has six positions within the chamber, the six positions including:

three forward positions, each where exhaust gas passes over the resisting face before passing over the stabilizing face;

three rearward positions, each where exhaust gas passes over the stabilizing face before passing over the resisting face;

whereby the user can choose between the three forward positions and three rearward positions.

4. The backpressure creation device of claim 3, further comprising:

two or more threaded adapters affixed to the stabilizing face;

a removable fastener;

the removable fastener interfacing with one of the two or more threaded adapters, thus affixing the pressure plate with respect to the chamber.

5. The backpressure creation device of claim 1, wherein the stabilizing face rests against a stabilizing wall within the chamber;

the stabilizing face and the stabilizing wall both being flat co-planar, thus simplifying installation.

6. The backpressure creation device of claim 1, wherein the inlet is a tapered shape with a first end and a second end;

the first end narrower than the second end;

the first end further from the chamber than the second end.

* * * * *